US006099236A

United States Patent [19]

Wiechman

[11] Patent Number: 6,099,236

[45] **Date of Patent: *Aug. 8, 2000**

[54] APPARATUS FOR CONTROLLING MOVEMENT OF AN IMPLEMENT RELATIVE TO A FRAME OF A WORK MACHINE

[75] Inventor: Dean A. Wiechman, Washington, Ill.

[73] Assignee: Caterpillar Inc., Peoria, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/985,828

[22] Filed: Dec. 5, 1997

[51] Int. Cl.[7] ..... E02F 3/00

[52] U.S. Cl. ..... 414/708; 414/700

[58] Field of Search ..... 414/700, 697, 414/680, 708; 91/361, 459

[56] References Cited

U.S. PATENT DOCUMENTS

| | | | |
|---|---|---|---|
| 3,140,001 | 7/1964 | Strader | 214/140 |
| 3,987,920 | 10/1976 | Parquet et al. | 414/700 |
| 4,006,834 | 2/1977 | Anderson et al. | 414/697 |
| 5,184,932 | 2/1993 | Misuda et al. | 414/685 |
| 5,188,502 | 2/1993 | Tonsor et al. | 414/700 |
| 5,189,940 | 3/1993 | Hosseini et al. | 91/361 |
| 5,195,864 | 3/1993 | Drake et al. | 414/699 |

FOREIGN PATENT DOCUMENTS

| | | | |
|---|---|---|---|
| 59-98935 | 6/1984 | Japan | E02F 3/80 |
| 62-185928 | 8/1987 | Japan | E02F 3/43 |
| 62-220620 | 9/1987 | Japan | E02F 3/43 |
| 757467 | 8/1980 | U.S.S.R. | B66F 9/22 |
| 1341341 | 9/1987 | U.S.S.R. | E02F 9/22 |

*Primary Examiner*—Donald W. Underwood
*Attorney, Agent, or Firm*—Maginot, Addison & Moore; Steve D. Lundquist

[57] ABSTRACT

An apparatus for controlling movement of an implement relative to a frame of a work machine is disclosed. The apparatus includes a lift arm having an implement, such as a bucket, pivotally coupled thereto. The apparatus also includes a pivot bar which is pivotally coupled to the lift arm via a coupling pin. A first hydraulic cylinder is coupled to the pivot bar. A second hydraulic cylinder is also coupled to the coupling pin. The first hydraulic cylinder and the second hydraulic cylinder are both actuated so as to lift the lift arm. Moreover, the first cylinder is actuated so as to tilt the bucket. A number of position sensors are provided to communicate output signals indicative of the position of the lift arm and the bucket to a controller. The controller processes such output signals and thereafter alters the position of a pair of proportional fluid valves associated with the first and second hydraulic cylinders.

11 Claims, 5 Drawing Sheets

APPARATUS FOR CONTROLLING MOVEMENT OF AN IMPLEMENT RELATIVE TO A FRAME OF A WORK MACHINE

TECHNICAL FIELD OF THE INVENTION

The present invention relates generally to a work machine, and more particularly to an apparatus and method for controlling movement of an implement relative to a frame of a work machine.

BACKGROUND OF THE INVENTION

A work machine, such as a wheel loader, typically includes a lift arm assembly having an implement, such as a bucket, secured thereto. In particular, a first end of a lift arm included in the lift arm assembly is pivotally coupled to the chassis or frame of the wheel loader, whereas the bucket is pivotally coupled to a second end of the lift arm. In such a configuration, the bucket may be lifted and lowered relative to the chassis of the wheel loader, and may also be tilted relative to the lift arm.

In order to provide the motive power necessary to lift and lower the bucket relative to the chassis, and also tilt the bucket relative to the lift arm, the wheel loader typically includes a number of fluid actuators, such as hydraulic cylinders or rams. In particular, a first hydraulic cylinder or pair of cylinders is provided to lift and lower the lift arm relative to the chassis of the wheel loader. Such a cylinder (or pair of cylinders), generally referred to as a "lift cylinder", is typically coupled at a first end to the chassis of the wheel loader, and at a second end to a portion of the lift arm. Similarly, a second hydraulic cylinder or pair of cylinders is provided to tilt the bucket relative to the lift arm of the wheel loader. Such a cylinder (or pair of cylinders), generally referred to as a "tilt cylinder", is typically coupled at a first end to a portion of the lift arm of the wheel loader, and at a second end to the bucket.

In such a configuration, separate fluid or hydraulic circuits are typically provided to control the position of the cylinders. In particular, wheel loaders which have heretofore been designed typically include a first fluid circuit for controlling the lift cylinder or cylinders, and a second fluid circuit for controlling the tilt cylinder or cylinders. The use of separate fluid circuits has a number of drawbacks associated therewith. For example, separate hydraulic components must be provided for each fluid circuit thereby undesirably increasing costs associated with the wheel loader.

Moreover, in such a configuration, during certain work operations only one of the cylinders or pair of cylinders may be actuated at any given time. In particular, during a high demand (i.e. requiring a relatively large amount of hydraulic power) lift operation, the lift cylinder(s) is actuated (e.g. being extended) while the tilt cylinder(s) is deactuated (e.g. not being extended or retracted), and vice versa. Hence, during a lift operation, the tilt cylinder(s) provide no mechanical assistance to the lift cylinder(s).

What is needed therefore is an apparatus and method for controlling movement of an implement relative to a frame of a work machine which overcomes one or more of the above-mentioned drawbacks.

DISCLOSURE OF THE INVENTION

In accordance with a first embodiment of the present invention, there is provided an apparatus for controlling movement of an implement relative to a frame of a work machine. The frame has a first frame coupling, a second frame coupling, and third frame coupling. The implement has a first implement coupling and a second implement coupling. The apparatus includes a lift arm having a pin coupling hole extending therethrough. The lift arm is pivotally secured to (i) the first frame coupling, and (ii) the first implement coupling. The apparatus also includes a coupling pin positioned in the pin coupling hole of the lift arm. The apparatus further includes a pivot bar which is pivotally secured to the coupling pin. Moreover, the apparatus includes a transfer link which is pivotally secured to (i) the pivot bar, and (ii) the second implement coupling. The apparatus yet further includes a first fluid cylinder which is coupled to (i) the second frame coupling, and (ii) the pivot bar. The apparatus also includes a second fluid cylinder which is coupled to (i) the third frame coupling, and (ii) the coupling pin. The apparatus further includes a cylinder control circuit for controlling movement of the first cylinder and the second cylinder. The cylinder control circuit includes a lever control having a tilt lever and a lift lever. Movement of the tilt lever causes actuation of the first cylinder so as to tilt the implement relative to the frame, whereas movement of the lift lever causes actuation of both the first cylinder and the second cylinder so as to lift the lift arm relative to the frame.

In accordance with a second embodiment of the present invention, there is provided a method for controlling movement of an implement relative to a frame of a work machine. The work machine has (i) a lift arm coupled to the frame, (ii) an implement coupled to the lift arm, and (iii) a lever control having a tilt lever and a lift lever. The method includes the step of moving the tilt lever so as to cause actuation of the first cylinder. The method also includes the step of tilting the implement relative to the frame in response to the tilt lever moving step. The method further includes the step of moving the lift lever so as to cause actuation of both the first cylinder and the second cylinder. Moreover, the method includes the step of lifting the lift arm relative to the frame in response to the lift lever moving step.

In accordance with a third embodiment of the present invention, there is provided an apparatus for controlling movement of an implement relative to a frame of a work machine. The frame has a first frame coupling, a second frame coupling, and third frame coupling. The implement has a first implement coupling and a second implement coupling. The apparatus includes a lift arm which has (i) a pin coupling hole extending therethrough, (ii) a first lift arm end portion, and (iii) a second lift arm end portion. The first lift arm end portion is pivotally secured to the first frame coupling, whereas the second lift arm end portion is pivotally secured to the first implement coupling. The pin coupling hole is located at a position which is interposed between the first lift arm end portion and the second lift arm end portion. The apparatus also includes a coupling pin positioned in the pin coupling hole of the lift arm. The apparatus further includes a pivot bar which is pivotally secured to the coupling pin. The pivot bar has a first pivot bar end portion and a second pivot bar end portion. Moreover, the apparatus includes a transfer link which has a first transfer link end portion, and a second transfer link end portion. The second pivot bar end portion is pivotally secured to the first transfer link end portion, whereas second transfer link end portion is pivotally secured to the second implement coupling. The apparatus yet further includes a first fluid cylinder which has a first rod and a first housing. The first housing is coupled to the second frame coupling, whereas the first rod is coupled to the first pivot bar end portion. The apparatus also includes a second fluid cylinder which has a second rod and a second housing. The second housing is coupled to the third frame coupling, whereas the second rod is coupled to the coupling pin. Moreover, the apparatus includes a cylinder control circuit for controlling movement of the first cylinder and the second cylinder. The cylinder control circuit includes a lever control having a tilt lever and a lift lever. Movement of the tilt lever causes actuation of the first cylinder so as to tilt the implement relative to the frame, whereas movement of the lift lever causes actuation of both the first cylinder and the second cylinder so as to lift the lift arm relative to the frame.

BEST MODE FOR CARRYING OUT THE INVENTION

Figure 1:
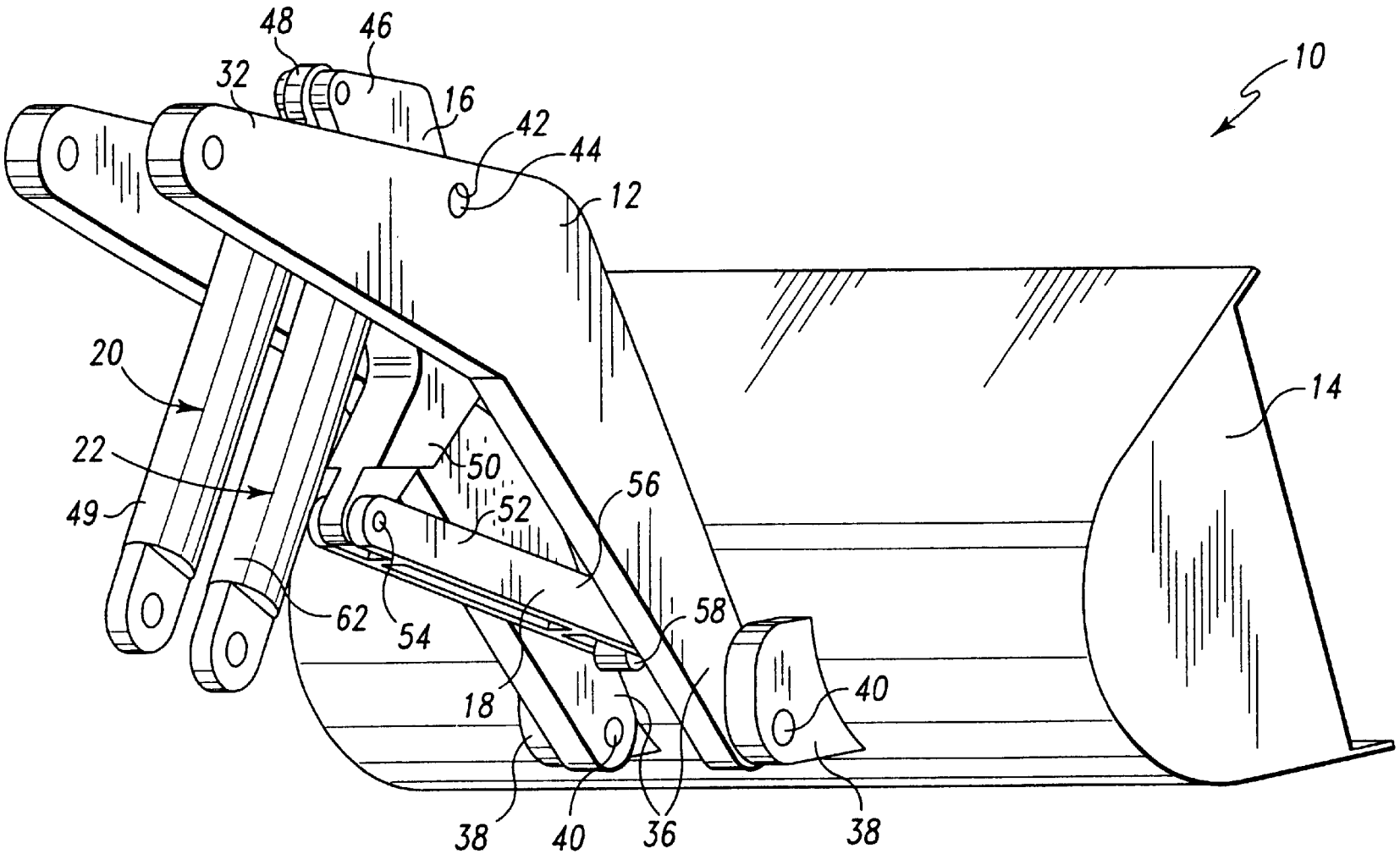
FIG. 1 is a fragmentary perspective view of a structural arm assembly and implement which incorporate features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
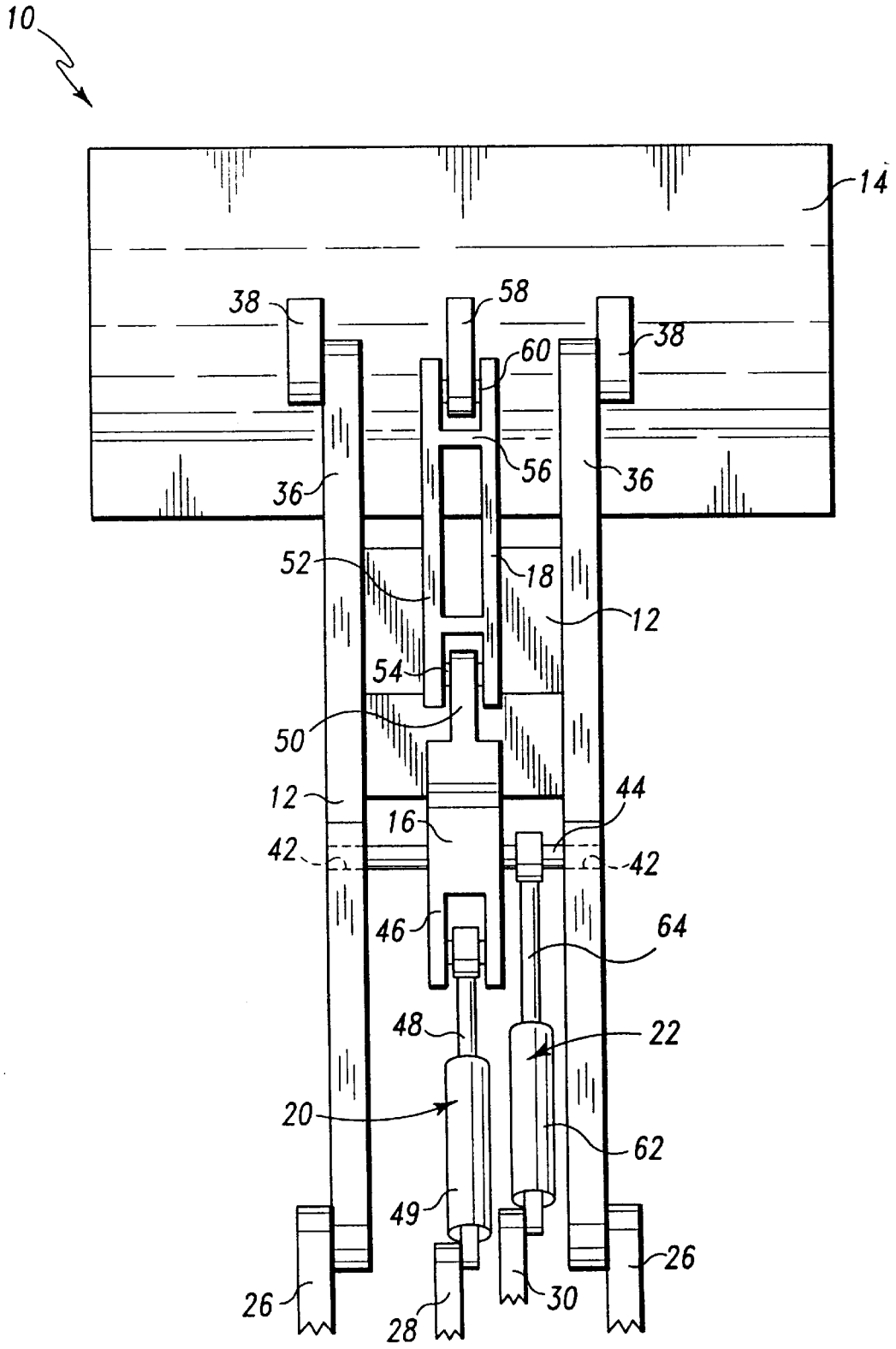
FIG. 2 is bottom elevational view of the structural arm assembly and the implement of FIG. 1.

Referring now to FIGS. 1 and 2, there is shown a structural arm assembly 10 having an implement, such as a bucket 14, secured thereto. The structural arm assembly 10 may be coupled to a work machine, such as a wheel loader (not shown), in order to perform any one of a number of work operations. The structural arm assembly 10 includes a box-boom type lift arm 12, a pivot bar 16, and a transfer link 18. The structural arm assembly 10 also includes a first fluid or hydraulic cylinder 20, and a second fluid or hydraulic cylinder 22.

Figure 4:
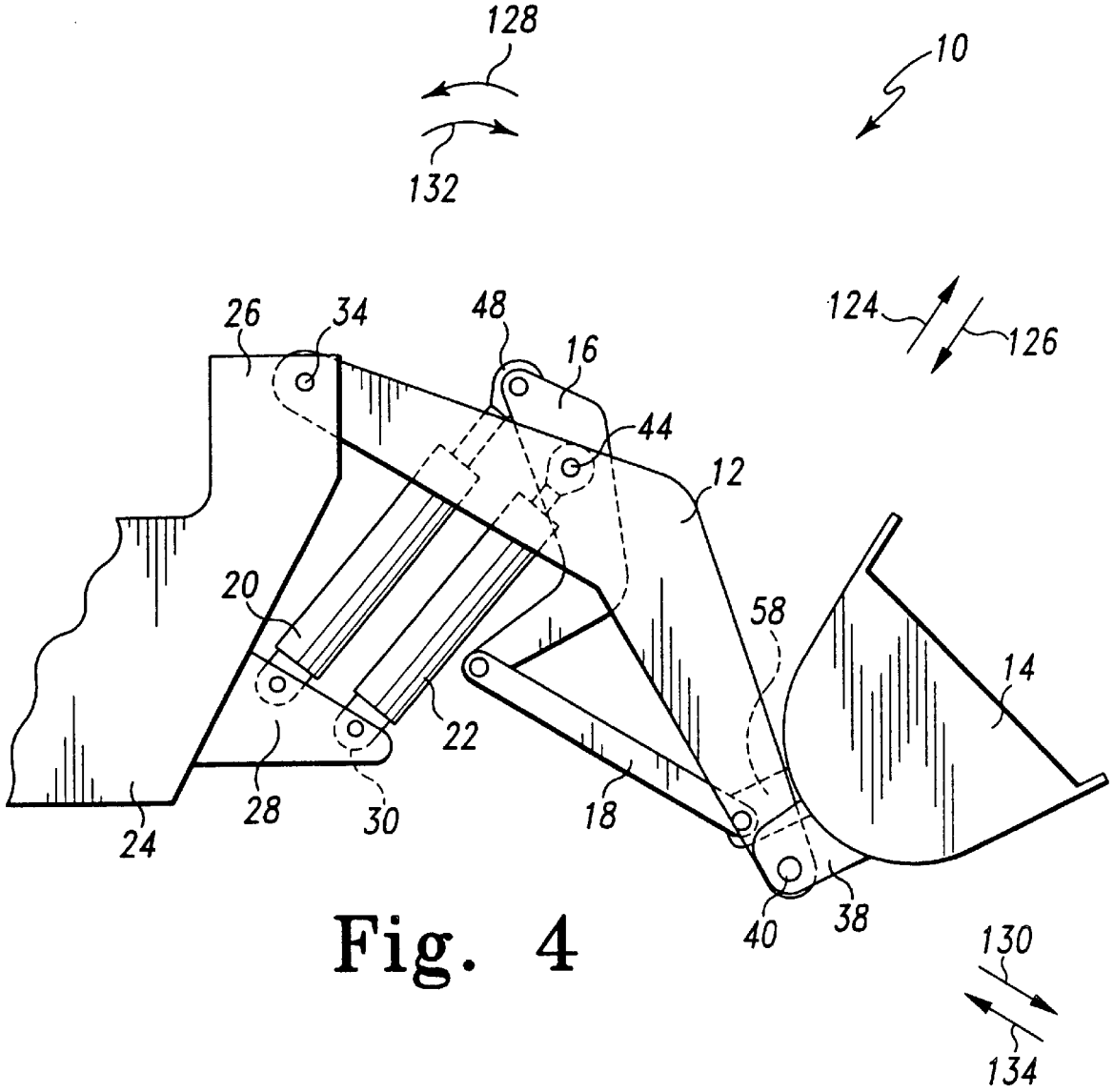
FIG. 4 is a side elevational view showing the structural arm assembly of FIG. 1 coupled to the frame of a work machine.
Figure 5:
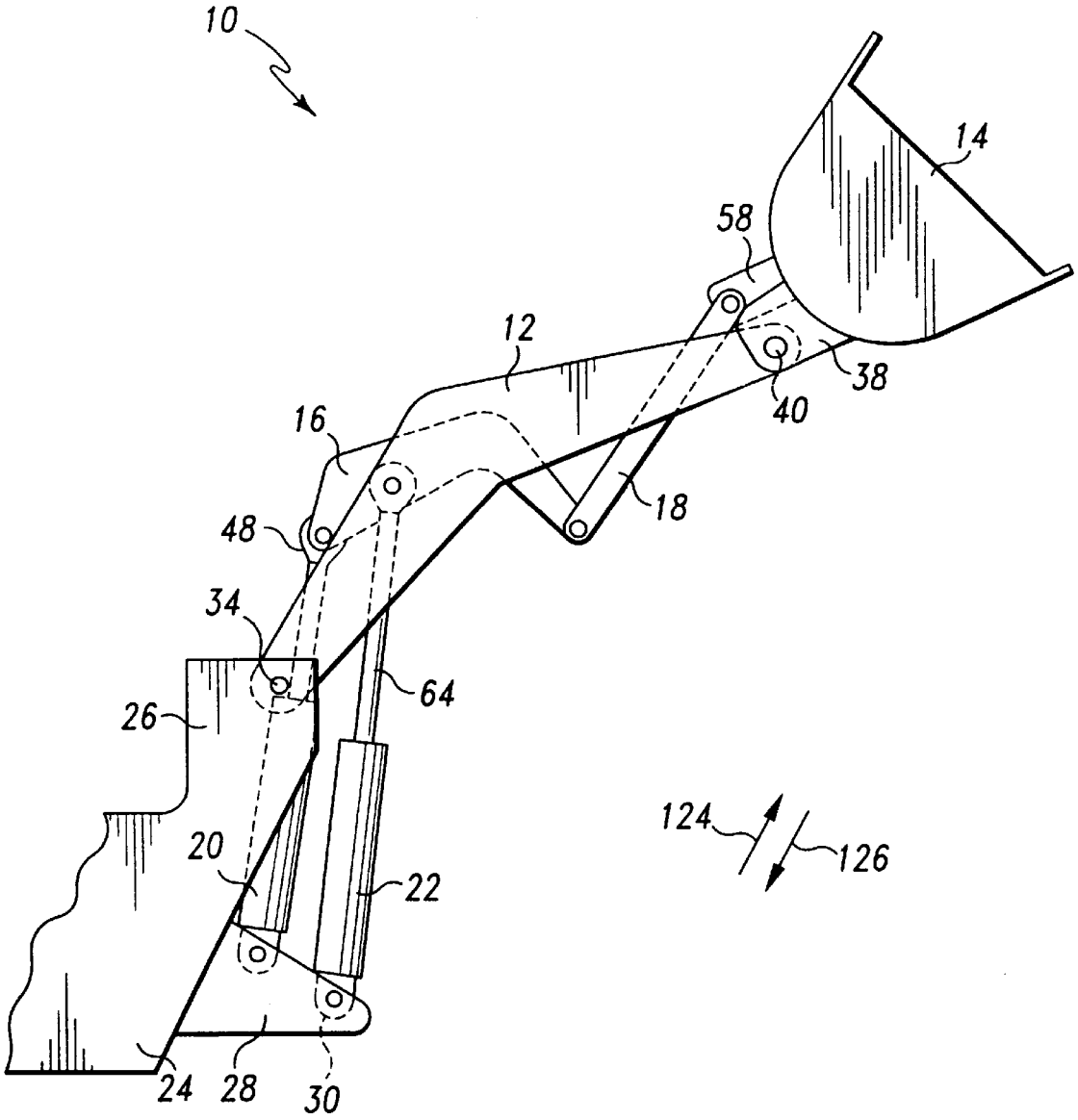
FIG. 5 is a view similar to FIG. 4, but showing the structural arm assembly located in the lift and tilt position.

The structural arm assembly 10 is secured to a frame 24 of a wheel loader (see FIGS. 4 and 5). In particular, the frame 24 includes a number of frame couplings 26, 28, 30. A first end portion 32 of the lift arm 12 is pivotally coupled to the frame coupling 26 via a pin joint 34. A second end portion 36 of the lift arm 12 is pivotally secured to a pair of implement couplings 38 via a pair of pin joints 40.

The pivot bar 16 is pivotally coupled to the lift arm 12. In particular, the lift arm 12 has a pair of pin coupling holes 42 defined therein. The pivot bar 16 pivots about a coupling pin 44 which is positioned in the pin coupling holes 42. A first end portion 46 of the pivot bar 16 is coupled to a rod 48 of the first hydraulic cylinder 20. A housing 49 of the first hydraulic cylinder 20 is coupled to the frame coupling 28, as shown in FIGS. 2 and 4.

A second end portion 50 of the pivot bar 16 is coupled to a first end portion 52 of the transfer link 18 via a pin joint 54. A second end portion 56 of the transfer link 18 is coupled to an implement coupling 58 via a pin joint 60.

As shown in FIG. 4, a housing 62 of the second hydraulic cylinder 22 is coupled to the frame coupling 30. A rod 64 of the second hydraulic cylinder 22 is coupled to the coupling pin 44. The hydraulic cylinders 20, 22 cooperate in order to lift the lift arm 12 and/or tilt the bucket 14. What is meant herein by the terms "lift" or "lifting" is movement of the lift arm 12 relative to the frame 24 of the work machine. Moreover, what is meant herein by the terms "tilt" or "tilting" is movement of the bucket 14 relative to the lift arm 12.

Hence, in order to lift the bucket 14, both the first hydraulic cylinder 20 and the second hydraulic cylinder 22 are actuated such that the rods 48, 64 are urged or otherwise extended out of the housings 49, 62, respectively. Similarly, in order to lower the bucket 14, both the first hydraulic cylinder 20 and the second hydraulic cylinder 22 are actuated such that the rods 48, 64 are urged or otherwise retracted into the housings 49, 62, respectively. What is meant herein by the term "actuated" is that the rods 48, 64 are urged or otherwise moved relative to the housings 49, 62, respectively. Therefore, the first hydraulic cylinder 20 is actuated when the rod 48 is being extended out of, or retracted into, the housing 49, whereas the second hydraulic cylinder 22 is actuated when the rod 64 is being extended out of, or retracted into, the housing 62. Conversely, the hydraulic cylinders 20, 22 are deactuated or otherwise inactive if the rods 48, 64 are not being urged or otherwise moved relative to the housings 49, 62, respectively.

Figure 3:
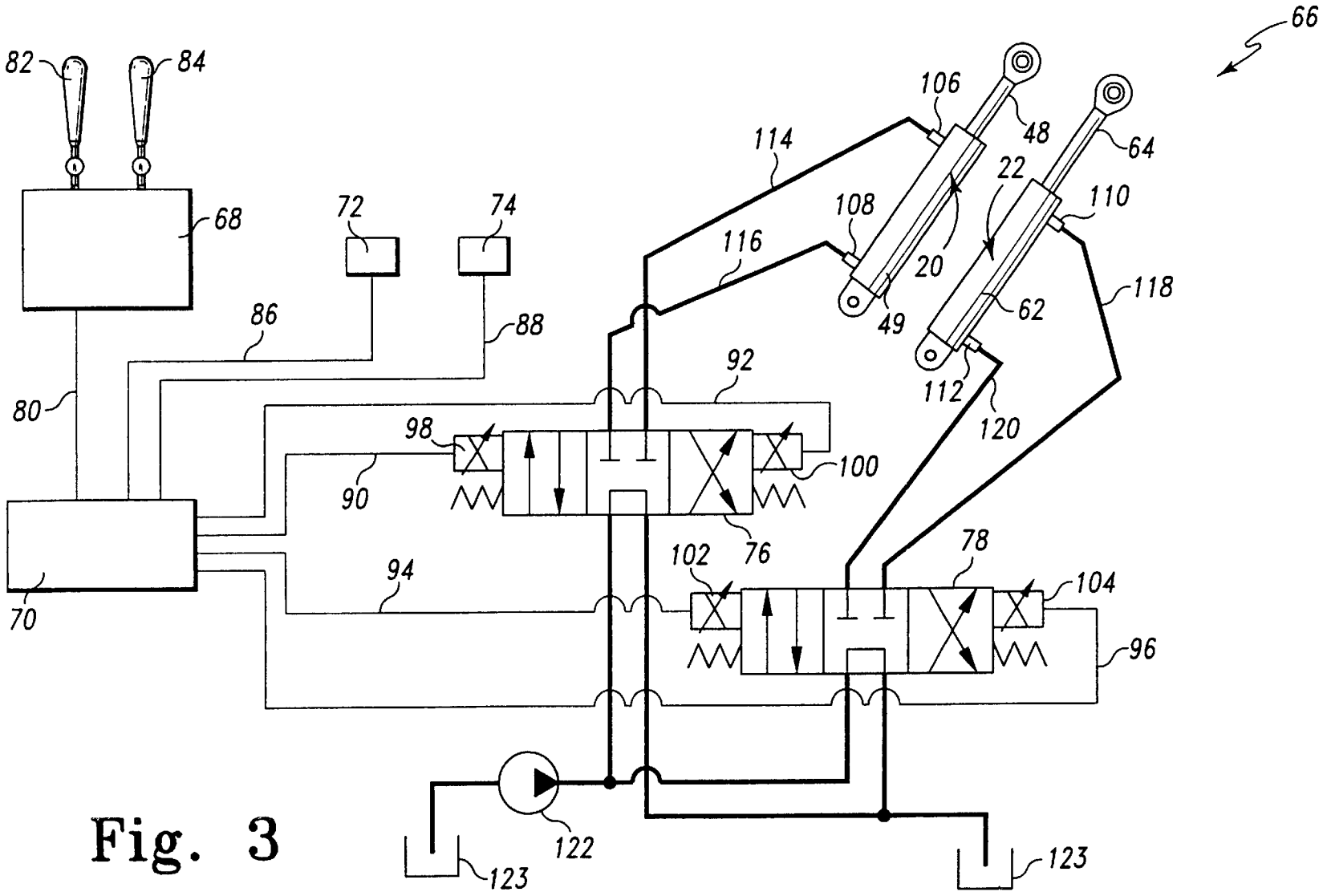
FIG. 3 is a schematic view of the cylinder control circuit which controls the hydraulic cylinders of the structural arm assembly of FIG. 1.

As shown in FIG. 3, a cylinder control circuit 66 is provided to control actuation of the first hydraulic cylinder 20 and the second hydraulic cylinder 22. The cylinder control circuit 66 includes a lever control 68, a controller 70, a pair of position sensors 72, 74, and a pair of electrohydraulic proportional fluid valves 76, 78. The lever control 68 includes a lift lever 82 and tilt lever 84, and is electrically coupled to the controller 70 via a signal line 80. The lever control 68 further includes a first position sensor (not shown) which is operatively coupled to the lift lever 82, and a second position sensor (not shown) which is operatively coupled to the tilt lever 84. The position sensors generate output signals commensurate with movement of the lift lever 82 and the tilt lever 84. In particular, if an operator of the work machine moves the lift lever 82 to a position indicative of a lift request, the position sensor associated with the lift lever 82 generates an output signal commensurate with the lift request which is transmitted to the controller 70 via the signal line 80.

The position sensors 72, 74 are electrically coupled to the controller 70 via a pair of signal lines 86, 88, respectively. The position sensor 72 measures the position (i.e. the angle) of the lift arm 12 relative to the frame 24. In particular, the position sensor 72 may include one or more rotary potentiometers which are operatively coupled to the lift arm 12 at the first frame coupling 26. Hence, as the position (i.e. the angle) of the lift arm 12 relative to the frame 24 changes, the position sensor 72 generates output signals commensurate with such changes in the position of the lift arm 12.

Similarly, the position sensor 74 measures the position (i.e. the angle) of the bucket 14 relative to the lift arm 12. In particular, the position sensor 74 may include one or more rotary potentiometers which are operatively coupled to the lift arm 12 at one or both of the first implement couplings 38. Hence, as the position (i.e. the angle) of the bucket 14 relative to the lift arm 12 changes, the position sensor 74 generates output signals commensurate with such changes in the position of the bucket 14.

The proportional valves 76, 78 are preferably solenoid-actuated, proportional fluid valves. The controller 70 is electrically coupled to the proportional valve 76 via a pair of signal lines 90, 92, whereas the controller 70 is electrically coupled to the proportional valve 78 via a pair of signal lines 94, 96. In particular, the proportional valve 76 includes a first solenoid 98 which is coupled to the controller 70 via the signal line 90, and a second solenoid 100 which is coupled to the controller 70 via the signal line 92. It should be appreciated that presence of control signals on the signal line 90 causes the proportional valve 76 to be urged rightwardly (relative to the view in the schematic of FIG. 3), whereas presence of control signals on the signal line 92 causes the proportional valve 76 to be urged leftwardly (relative to the view in the schematic of FIG. 3). Similarly, the proportional valve 78 includes a first solenoid 102 which is coupled to the controller 70 via the signal line 94, and a second solenoid 104 which is coupled to the controller 70 via the signal line 96. It should be appreciated that presence of control signals on the signal line 94 causes the proportional valve 78 to be urged rightwardly (relative to the view in the schematic of FIG. 3), whereas presence of control signals on the signal line 96 causes the proportional valve 78 to be urged leftwardly (relative to the view in the schematic of FIG. 3).

The proportional valve 76 is in fluid communication with the first hydraulic cylinder 20, whereas the proportional valve 78 is in fluid communication with the second hydraulic cylinder 22. In particular, the proportional valve 76 is coupled to a rod end 106 of the first hydraulic cylinder 20 via a fluid line 114, whereas the proportional valve 76 is coupled to a head end 108 of the first hydraulic cylinder 20 via a fluid line 116. Similarly, the proportional valve 78 is coupled to a rod end 110 of the second hydraulic cylinder 22 via a fluid line 118, whereas the proportional valve 78 is coupled to a head end 112 of the second hydraulic cylinder 22 via a fluid line 120.

Hence, the proportional valves 76, 78 may be selectively positioned so as to actuate the hydraulic cylinders 20, 22. In particular, when the proportional valve 76 is urged rightwardly (relative to the view in the schematic of FIG. 3), the head end 108 of the hydraulic cylinder 20 is placed in fluid communication with a fluid pump 122 thereby actuating the hydraulic cylinder 20 such that the rod 48 is extended out of the housing 49. In addition, at such a rightward position, the rod end 106 of the hydraulic cylinder 20 is placed in fluid communication with a fluid reservoir 123.

Conversely, when the proportional valve 76 is urged leftwardly (relative to the view in the schematic of FIG. 3), the rod end 106 of the hydraulic cylinder 20 is placed in fluid communication with the fluid pump 122 thereby actuating the hydraulic cylinder 20 such that the rod 48 is retracted into the housing 49. In addition, at such a leftward position, the head end 108 of the hydraulic cylinder 20 is placed in fluid communication with the fluid reservoir 123.

Moreover, when the proportional valve 78 is urged rightwardly (relative to the view in the schematic of FIG. 3), the head end 112 of the hydraulic cylinder 22 is placed in fluid communication with the fluid pump 122 thereby actuating the hydraulic cylinder 22 such that the rod 64 is extended out of the housing 62. In addition, at such a rightward position, the rod end 110 of the hydraulic cylinder 22 is placed in fluid communication with the fluid reservoir 123.

Conversely, when the proportional valve 78 is urged leftwardly (relative to the view in the schematic of FIG. 3), the rod end 110 of the hydraulic cylinder 22 is placed in fluid communication with the fluid pump 122 thereby actuating the hydraulic cylinder 22 such that the rod 64 is retracted into the housing 62. In addition, at such a leftward position, the head end 112 of the hydraulic cylinder 22 is placed in fluid communication with the fluid reservoir 123.

INDUSTRIAL APPLICABILITY

In operation, lifting or lowering of the lift arm 12 is initiated when the operator of the work machine (not shown) moves or otherwise positions the lift lever 82 in the desired direction. An output signal commensurate with the direction (i.e. lift or lower) and degree (change of position or angle of the lift arm 12 relative to the frame 24) of movement of the lift lever 82 is generated by the position sensor associated therewith and sent via the signal line 80 to the controller 70. The controller 70 processes the signal and dependent upon the lift mode selected (i.e. direction and degree of movement), generates an appropriate output signal on one or more of the signal lines 90, 92, 94, or 96.

For example, if the operator initiates a lifting operation of the lift arm 12 with the lift lever 82, the controller 70 receives an output signal commensurate with the direction (i.e. lift) and the degree (including speed) of the lifting request from the position sensor (not shown) associated with the lift lever 82. Thereafter, the controller 70 generates an output signal on the signal lines 90 and 94. The output signal on the signal line 90 actuates the proportional valve 76 thereby moving the proportional valve 76 rightwardly (relative to the view in the schematic of FIG. 3). At such a rightward position, the proportional valve 76 controllably directs pressurized operation fluid from the fluid pump 122 to the head end 108 of the first hydraulic cylinder 20 thereby causing actuation thereof. In particular, presence of pressurized fluid in the head end 108 of the hydraulic cylinder 20 causes the hydraulic cylinder 20 to be actuated such that the rod 48 is extended or otherwise urged out of the housing 49. Such actuation (i.e. extension) of the first hydraulic cylinder 20 causes the first end 46 of the pivot bar 16 and hence the lift arm 12 to be urged in the general direction of arrow 124 of FIGS. 4 and 5. Simultaneously, the output signal on the signal line 94 actuates the proportional valve 78 thereby moving the proportional valve 78 rightwardly (relative to the view in the schematic of FIG. 3). At such a rightward position, the proportional valve 78 controllably directs pressurized operation fluid from the fluid pump 122 to the head end 112 of the second hydraulic cylinder 22 thereby causing actuation thereof. In particular, presence of pressurized fluid in the head end 112 of the hydraulic cylinder 22 causes the hydraulic cylinder 22 to be actuated such that the rod 64 is extended or otherwise urged out of the housing 62. Such actuation (i.e. extension) of the second hydraulic cylinder 22 causes the coupling pin 44 and hence the lift arm 12 to be urged in the general direction of arrow 124 of FIGS. 4 and 5. It should be appreciated that the controller 70 coordinates actuation of the first hydraulic cylinder 20 and the second hydraulic cylinder 22 during such a lift operation. In particular, the controller 70 independently adjusts the speed at which the rods 48, 64 are extended out of the housings 49, 62, respectively, so as to produce a coordinated lift operation commensurate with the lift request. More specifically, the controller 70 may extend the rod 48 at a speed which is different from the speed at which the rod 64 is extended.

Conversely, if the operator initiates a lowering operation of the lift arm 12 with the lift lever 82, the controller 70 receives an output signal commensurate with the direction (i.e. lower) and the degree (including speed) of the lowering request from the position sensor (not shown) associated with the lift lever 82. Thereafter, the controller 70 generates an output signal on the signal lines 92 and 96. The output signal on the signal line 92 actuates the proportional valve 76 thereby moving the proportional valve 76 leftwardly (relative to the view in the schematic of FIG. 3). At such a leftward position, the proportional valve 76 controllably directs pressurized operation fluid from the fluid pump 122 to the rod end 106 of the first hydraulic cylinder 20 thereby causing actuation thereof. In particular, presence of pressurized fluid in the rod end 106 of the hydraulic cylinder 20 causes the hydraulic cylinder 20 to be actuated such that the rod 48 is retracted or otherwise urged into the housing 49. Such actuation (i.e. retraction) of the first hydraulic cylinder 20 causes the first end 46 of the pivot bar 16 and hence the lift arm 12 to be urged in the general direction of arrow 126 of FIGS. 4 and 5. Simultaneously, the output signal on the signal line 96 actuates the proportional valve 78 thereby moving the proportional valve 78 leftwardly (relative to the view in the schematic of FIG. 3). At such a leftward position, the proportional valve 78 controllably directs pressurized operation fluid from the fluid pump 122 to the rod end 110 of the second hydraulic cylinder 22 thereby causing actuation thereof. In particular, presence of pressurized fluid in the rod end 110 of the hydraulic cylinder 22 causes the hydraulic cylinder 22 to be actuated such that the rod 64 is retracted or otherwise urged into the housing 62. Such actuation (i.e. retraction) of the second hydraulic cylinder 22 causes the coupling pin 44 and hence the lift arm 12 to be urged in the general direction of arrow 126 of FIGS. 4 and 5. It should be appreciated that the controller 70 coordinates actuation of the first hydraulic cylinder 20 and the second hydraulic cylinder 22 during such a lowering operation. In particular, the controller 70 independently adjusts the speed at which the rods 48, 64 are retracted into the housings 49, 62, respectively, so as to produce a coordinated lowering operation commensurate with the lowering request. More specifically, the controller 70 may retract the rod 48 at a speed which is different from the speed at which the rod 64 is retracted.

If the operator initiates a tilting operation with the tilt lever 84 such that the bucket 14 is to be tilted downwardly, the controller 70 receives an output signal commensurate with the direction (i.e. downward tilt) and the degree (including speed) of the tilting request from the position sensor (not shown) associated with the tilt lever 84. Thereafter, the controller 70 generates an output signal on the signal line 92. The output signal on the signal line 92 actuates the proportional valve 76 thereby moving the proportional valve 76 leftwardly (relative to the view in the schematic of FIG. 3). At such a leftward position, the proportional valve 76 controllably directs pressurized operation fluid from the fluid pump 122 to the rod end 106 of the first hydraulic cylinder 20 thereby causing actuation thereof. In particular, presence of pressurized fluid in the rod end 106 of the hydraulic cylinder 20 causes the hydraulic cylinder 20 to be actuated such that the rod 48 is retracted or otherwise urged into the housing 49. Such actuation (i.e. retraction) of the first hydraulic cylinder 20 causes the pivot bar 16 to rotate about the coupling pin 44 in the general direction of arrow 128 of FIG. 4 thereby causing the transfer link 18 to be urged in the general direction of arrow 130 of FIG. 4. Such movement of the transfer link 18 causes the bucket 14 to rotate about the pin joints 40 thereby tilting the bucket 14 in a downward direction.

Conversely, if the operator initiates a tilting operation with the tilt lever 84 such that the bucket 14 is to be tilted upwardly, the controller 70 receives an output signal commensurate with the direction (i.e. upward tilt) and the degree (including speed) of the tilting request from the position sensor (not shown) associated with the tilt lever 84. Thereafter, the controller 70 generates an output signal on the signal line 90. The output signal on the signal line 90 actuates the proportional valve 76 thereby moving the proportional valve 76 rightwardly (relative to the view in the schematic of FIG. 3). At such a rightward position, the proportional valve 76 controllably directs pressurized operation fluid from the fluid pump 122 to the head end 108 of the first hydraulic cylinder 20 thereby causing actuation thereof. In particular, presence of pressurized fluid in the head end 108 of the hydraulic cylinder 20 causes the hydraulic cylinder 20 to be actuated such that the rod 48 is extended or otherwise urged out of the housing 49. Such actuation (i.e. extension) of the first hydraulic cylinder 20 causes the pivot bar 16 to rotate about the coupling pin 44 in the general direction of arrow 132 of FIG. 4 thereby causing the transfer link 18 to be urged in the general direction of arrow 134 of FIG. 4. Such movement of the transfer link 18 causes the bucket 14 to rotate about the pin joints 40 thereby tilting the bucket 14 in an upward direction.

During such movement of the lift arm 12 and/or the pivot bar 16 by the hydraulic cylinders 20, 22, the position sensor 72 transmits output signals indicative of the position (i.e. the angle) of the lift arm 12 relative to the frame 24 to the controller 70, whereas the position sensor 74 transmits output signals indicative of the position (i.e. the angle) of the bucket 14 relative to the lift arm 12 to the controller 70. The controller 70 processes such output signals and thereafter selectively controls the magnitude of the signals being generated on the signal lines 90, 92, 94, 96 thereby controlling movement of the hydraulic cylinders 20, 22. Such "closed-loop" control of the hydraulic cylinders 20, 22 allows for integrated control of the lift and tilt functions associated with the structural arm assembly 10. For example, if during initiation of the lift request as described above, the operator desired to maintain the bucket 14 at its current angle relative to the lift arm 12 (i.e. the operator did not generate a simultaneous tilt request with the tilt lever 84), the controller 70 may alter the magnitude of the output signals on the signal lines 90, 92, 94, 96 so as to prevent the angle of the bucket 14 relative to the lift arm 12 from changing. In particular, as the lift arm 12 is being lifted in the manner previously described, output signals commensurate with the angle of the bucket 14 relative to the lift arm 12 are sent to the controller 70 from the position sensor 74. The controller may then alter the magnitude of the output signals being generated on the signal lines 90, 92, 94, 96 so as to selectively alter the magnitude of the flow of fluid through the proportional valves 76, 78 such that the angle of the bucket 14 relative to the lift arm 12 remains constant during the lift operation. It should be appreciated that the angle of the bucket 14 relative to the lift arm 12 may also be held constant during lowering of the lift arm 12.

Moreover, if during initiation of the lift request as described above, the operator desired to maintain the bucket 14 in a parallel relationship with the ground or other surface on which the work machine is located, the controller 70 may alter the magnitude of the output signals on the signal lines 90, 92, 94, 96 so as to prevent the angle of the bucket 14 relative to the ground from changing (i.e. a parallel lift operation). In particular, as the lift arm 12 is being lifted in the manner previously described, output signals commensurate with the angle of the lift arm 12 relative to the frame 24 are sent to the controller 70 from the position sensor 72, whereas output signals commensurate with the angle of the bucket 14 relative to the lift arm 12 are sent to the controller 70 from the position sensor 74. The controller may then alter the magnitude of the output signals being generated on the signal lines 90, 92, 94, 96 so as to selectively alter the magnitude of the flow of fluid through the proportional valves 76, 78 such that the angle of the bucket 14 relative to the ground remains constant during such a parallel lift operation. It should be appreciated that the angle of the bucket 14 relative to the ground may also be held constant during lowering of the lift arm 12.

It should be further appreciated that such "closed-loop" control of the cylinders 20, 22 via use of the controller 70 and the position sensors 72, 74 allows the position of the lift arm 12 relative the frame 24 and the bucket 14 relative the lift arm 12 to be maintained within numerous predetermined operation parameters. For example, simultaneous lift and tilt operations may be controlled (e.g. prioritized) by the controller 70 based on the position output signals being generated by the position sensors 72, 74.

Moreover, from the above discussion it should be appreciated that the structural arm assembly 10 allows for use of smaller hydraulic components relative to structural arm assemblies which have heretofore been designed. In particular, by utilizing both the first hydraulic cylinder 20 and the second hydraulic cylinder 22 to lift and lower the lift arm 12, relatively small hydraulic cylinders and proportional valves may be utilized. For example, if a given lift arm has a dedicated lift cylinder associated therewith (i.e. the lift cylinder is not utilized to tilt the bucket), all of the fluid flow to operate the lift cylinder (e.g. 300 liters/minute of fluid flow) must flow through the lift valve associated therewith. However, in the case of the lift arm 12 of the structural arm assembly 10, the fluid flow requirement (e.g. 300 liters/minute of fluid flow) may be split between the proportional valves 76, 78 thereby allowing the proportional valves to be configured as relatively small fluid valves (e.g. 150 liters/minute of fluid flow per valve).

Moreover, in addition to use of smaller hydraulic components, the structural arm assembly 10 allows for use of fewer components relative to structural arm assemblies which have heretofore been designed. For example, in addition to being utilized to lift the lift arm 12 in cooperation with the second hydraulic cylinder 22, the first hydraulic cylinder 20 is also utilized to tilt the bucket 14 thereby eliminating the need to provide a separate, dedicated tilt cylinder or cylinders.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

For example, although the first hydraulic cylinder 20 and the second hydraulic cylinder 22 have herein been described as each being a single hydraulic cylinder, it should be appreciated that other cylinder arrangements are contemplated for use in the present invention. For example, the first hydraulic cylinder 20 may be configured as a first pair of hydraulic cylinders, whereas the second hydraulic cylinder 22 may be configured as a second pair of hydraulic cylinders.

Moreover, it should be appreciated that numerous types of operator manipulated mechanisms are contemplated for use as the lift lever 82 and the tilt lever 84 of the present invention. In particular, any type of operator manipulated mechanism which allows the operator to initiate a lift request of the lift arm 12 or a tilt request of the bucket 14 may be utilized in the present invention. For example, the lift lever 82 and the tilt lever 84 may be embodied as a number of operator manipulated buttons, a dial-type positioning mechanism, or a joystick-type positioning mechanism.

What is claimed is:

1. An apparatus for controlling movement of an implement relative to a frame of a work machine, with (i) said frame having a first frame coupling, a second frame coupling, and a third frame coupling, and (ii) said implement having a first implement coupling and a second implement coupling, comprising:

a lift arm having a pin coupling hole extending therethrough, said lift arm being pivotally securable to (i) said first frame coupling, and (ii) said first implement coupling;

a coupling pin positioned in said pin coupling hole of said lift arm;

a pivot bar which is pivotally secured to said coupling pin;

a transfer link which is pivotally secured to said pivot bar, said transfer link further being securable to said second implement coupling;

a first fluid cylinder which is couplable to said second frame coupling, said first fluid cylinder further being coupled to said pivot bar;

a second fluid cylinder which is couplable to said third frame coupling, said second fluid cylinder further being coupled said coupling pin; and a cylinder control circuit for controlling movement of said first cylinder and said second cylinder, wherein (i) said cylinder control circuit includes a lever control having a tilt lever and a lift lever, (ii) movement of said tilt lever causes actuation of said first cylinder so as to tilt said implement relative to said frame, and (iii) movement of said lift lever causes actuation of both said first cylinder and said second cylinder so as to lift said lift arm relative to said frame.

2. The apparatus of claim 1, wherein said cylinder control circuit further includes:

a controller, a first position sensor electrically coupled to said controller, said first position sensor detects position of said lift arm relative to said frame and outputs first position signals to said controller, and a second position sensor electrically coupled to said controller, said second position sensor detects position of said implement relative to said lift arm and outputs second position signals to said controller.

3. The apparatus of claim 2, wherein said cylinder control circuit further includes:

a first fluid valve which is in fluid communication with said first fluid cylinder, wherein (i) said first fluid valve is electrically coupled to said controller, and (ii) said first fluid valve actuates said first fluid cylinder based on (a) said first position signals which are output by said first position sensor, and (b) said second position signals which are output by said second position sensor, and a second fluid valve which is in fluid communication with said second fluid cylinder, wherein (i) said second fluid valve is electrically coupled to said controller, and (ii) said second fluid valve actuates said second fluid cylinder based on (a) said first position signals which are output by said first position sensor, and (b) said second position signals which are output by said second position sensor.

4. The apparatus of claim 3, wherein said cylinder control circuit further includes:

an operational fluid pump which is in fluid communication with both said first fluid valve and said second fluid valve, and a fluid reservoir which is in fluid communication with both said first fluid valve and said second fluid valve.

5. The apparatus of claim 1, wherein:

said lift arm further has a first lift arm end portion and a second lift arm end portion, said pivot bar has a first pivot bar end portion and a second pivot bar end portion, said transfer link has a first transfer link end portion and a second transfer link end portion, said first lift arm end portion is pivotally securable to said first frame coupling, said second lift arm end portion is pivotally securable to said first implement coupling, said first pivot bar end portion is pivotally secured to said first fluid cylinder, said second pivot bar end portion is pivotally secured to said first transfer link end portion, and said second transfer link end portion is pivotally securable to said second implement coupling.

6. The apparatus of claim 5, wherein said pin coupling hole is located at a position which is interposed between said first lift arm end portion and said second lift arm end portion.

7. The apparatus of claim 5, wherein:

said first fluid cylinder has a first rod and a first housing, said second fluid cylinder has a second rod and a second housing, said first housing is couplable to said second frame coupling, said first rod is coupled to said first pivot bar end portion, said second housing is couplable to said third frame coupling, and said second rod is coupled to said coupling pin.

8. An apparatus for controlling movement of an implement relative to a frame of a work machine, with (i) said frame having a first frame coupling, a second frame coupling, and a third frame coupling, and (ii) said implement having a first implement coupling and a second implement coupling, comprising:

a lift arm, wherein (i) said lift arm has a pin coupling hole extending therethrough, (ii) said lift arm further has a first lift arm end portion and a second lift arm end portion, (iii) said first lift arm end portion is pivotally securable to said first frame coupling, (iv) said second lift arm end portion is pivotally securable to said first implement coupling, and (v) said pin coupling hole is located at a position which is interposed between said first lift arm end portion and said second lift arm end portion;

a coupling pin positioned in said pin coupling hole of said lift arm;

a pivot bar which is pivotally secured to said coupling pin, said pivot bar having a first pivot bar end portion and a second pivot bar end portion;

a transfer link, wherein (i) said transfer link includes a first transfer link end portion and a second transfer link end portion, (ii) said second pivot bar end portion is pivotally secured to said first transfer link end portion, and (iii) said second transfer link end portion is pivotally securable to said second implement coupling;

a first fluid cylinder, wherein (i) said first fluid cylinder has a first rod and a first housing, (ii) said first housing is couplable to said second frame coupling, and (iii) said first rod is coupled to said first pivot bar end portion;

a second fluid cylinder, wherein (i) said second fluid cylinder has a second rod and a second housing, (ii) said second housing is coupled to said third frame coupling, and (iii) said second rod is coupled to said coupling pin; and a cylinder control circuit for controlling movement of said first cylinder and said second cylinder, wherein (i) said cylinder control circuit includes a lever control having a tilt lever and a lift lever, (ii) movement of said tilt lever causes actuation of said first cylinder so as to tilt said implement relative to said frame, and (iii) movement of said lift lever causes actuation of both said first cylinder and said second cylinder so as to lift said lift arm relative to said frame.

9. The apparatus of claim 8, wherein said cylinder control circuit further includes:

a controller, a first position sensor electrically coupled to said controller, said first position sensor detects position of said lift arm relative to said frame and outputs first position signals to said controller, and a second position sensor electrically coupled to said controller, said second position sensor detects position of said implement relative to said lift arm and outputs second position signals to said controller.

10. The apparatus of claim 9, wherein said cylinder control circuit further includes:

a first fluid valve which is in fluid communication with said first fluid cylinder, wherein (i) said first fluid valve is electrically coupled to said controller, and (ii) said first fluid valve actuates said first fluid cylinder based on (a) said first position signals which are output by said first position sensor, and (b) said second position signals which are output by said second position sensor, and a second fluid valve which is in fluid communication with said second fluid cylinder, wherein (i) said second fluid valve is electrically coupled to said controller, and (ii) said second fluid valve actuates said second fluid cylinder based on (a) said first position signals which are output by said first position sensor, and (b) said second position signals which are output by said second position sensor.

11. The apparatus of claim 10, wherein said cylinder control circuit further includes:

an operational fluid pump which is in fluid communication with both said first fluid valve and said second fluid valve, and a fluid reservoir which is in fluid communication with both said first fluid valve and said second fluid valve.

* * * * *